US006158974A

United States Patent [19]

Tarutani et al.

[11] Patent Number: 6,158,974

[45] Date of Patent: Dec. 12, 2000

[54] RECIPROCATING COMPRESSOR

[75] Inventors: Tomoji Tarutani; Hirofumi Sato; Yasunori Ueda; Satoru Kuramoto, all of Aichi-ken, Japan

[73] Assignee: Kabushiki Kaisha Toyoda Jidoshokki Seisakusho, Kariya, Japan

[21] Appl. No.: 09/044,898

[22] Filed: Mar. 20, 1998

[30] Foreign Application Priority Data

Mar. 25, 1997 [JP] Japan ..... 9-072136

[51] Int. Cl.[7] ..... F04B 1/12; F04B 27/08

[52] U.S. Cl. ..... 417/269

[58] Field of Search ..... 417/269, 571, 417/560; 137/856

[56] References Cited

U.S. PATENT DOCUMENTS 5,947,698 9/1999 Ikeda et al. ..... 417/269

*Primary Examiner*—Teresa Walberg

*Assistant Examiner*—Vinod D Patel

*Attorney, Agent, or Firm*—Morgan & Finnegan, L.L.P.

[57] ABSTRACT

The retainers of a reciprocating compressor are kept from deforming by the pressure of discharged refrigerant when there is a overload due to liquid compression and so forth, by linking inclined pieces with a gentle slope on the retainers serving as members for restricting the opening angle of the reed valve type discharge valves, with a linking member or by making the width dimension of the base portion of the inclined pieces with a gentle slope greater than the width dimension of the tip portion thereof, thereby improving the rigidity of the retainers, and consequently improving the reliability of the reciprocating compressor.

14 Claims, 7 Drawing Sheets

RECIPROCATING COMPRESSOR

BACKGROUND OF THE INVENTION

1. Field of the Invention

The present invention relates to a reciprocating compressor used for vehicle air-conditioning, and the like.

2. Description of the Related Art

Swash plate type reciprocating compressors used as compressors for vehicle air-conditioning, and the like are conventionally known. A swash plate type reciprocating compressor generally comprises a cylinder assembly formed from a front side cylinder block and a rear side cylinder block joined one to another. A plurality of cylinder bores are provided in the area around the center axis of the cylinder assembly, so as to pass therethrough between the front and rear end faces. Double-headed pistons are provided so as to be slidable within the cylinder bores. Also, a drive shaft is rotatably supported at the center axis of the cylinder assembly, this drive shaft being provided with a cam plate (a swash plate in this case) as a means for converting the rotational motion of the drive shaft into linear motion. The double-headed pistons are fitted to the cam plate via shoes, thus constructing an apparatus in which the rotation of the drive shaft causes the reciprocating movement of the double-headed pistons within the cylinder bores, thereby compressing a refrigerant gas in the cylinder bores.

Also, with such swash plate compressors, a cylinder cover having a discharge chamber and suction chamber therein is provided at either end of the cylinder assembly, and a valve plate is provided between the cylinder cover and cylinder assembly. Further, a plurality of suction ports are bored to link the cylinder bores and the suction chamber, and a plurality of discharge ports are bored to link the cylinder bores and the discharge chamber. Also, suction valve forming plate with integrally formed suction valves for controlling the opening and closing of each suction port is provided between the valve plate and the cylinder assembly, and a discharge valve forming plate with integrally formed reed-type discharge valves for controlling the opening and closing of each discharge port is provided between the valve plate and the cylinder cover.

Here, since the reed-type discharge valves for such swash plate type compressors are formed of thin metal plates, in the event that the plates are excessively bent due to the pressure of the refrigerant gas being discharged from the discharge ports, the valves may be permanently warped. Accordingly, a metal retainer plate with integrally formed retainers and a gasket for sealing each chamber is conventionally introduced between the discharge valve forming plate and cylinder cover to restrict the degree of opening of each reed-type discharge valve. Further, the retainers have a slanted portion which gently rises from the base surface of the retainer plate at an angle generally approximating the angle of the reed-type valve when opened, and the degree of opening of the reed-type discharge valve is restricted within this slanted portion.

However, there have been cases of the base portion of the slanted pieces bending due to great discharge pressure when there is a overload due to liquid compression and the like acting on the aforementioned slanted pieces either via the discharge valves or directly. Also, in the event that the base portion of the slanted piece is greatly bent, there is the possibility that the degree of opening of the reed-type discharge valves cannot be restricted to the predetermined level.

SUMMARY OF THE INVENTION

It is therefor an object of the present intention to provide a reciprocating compressor which eliminates the possibility of the retainers being deformed by discharge pressure when there is a overload due to liquid compression and the like, and which uses reed-type discharge valves with improved reliability.

In order to achieve the above objects, a reciprocating compressor comprises: a cylinder assembly wherein a plurality of cylinder bores are arrayed upon a certain circumference; a drive shaft rotatably supported at the center of the cylinder assembly; a cam plate mounted to the drive shaft; a plurality of pistons which reciprocatingly move within the cylinder bores, the rotational force of the drive shaft transmitted as reciprocating motion thereto via the cam plate; at least one cylinder cover provided so as to cover the end of the cylinder assembly, with a generally loop-shaped discharge chamber and a generally loop-shaped suction chamber formed therein in a generally concentric manner; a valve plate provided between the cylinder cover and the cylinder assembly; a plurality of discharge ports bored at certain positions on a certain circumference in the valve plate; a discharge valve formation plate which is introduced between the cylinder cover and the valve plate, integrally forming a plurality of reed discharge valves which open and close the discharge ports; a retainer plate which is introduced between the cylinder cover and the discharge valve formation plate, having a loop-shaped sealing portion which seals the edge of the inner circumferential wall of the discharge chamber formed in the cylinder cover, the retainer plate being integrally formed of a plurality of retainers for restricting the degree of opening of the discharge valves, the retainers radially protruding from the periphery of the loop-shaped sealing portion; and linking members linking neighboring retainers one to another.

It is preferable that the above linking members linking neighboring retainers one to another are formed integrally with a retainer plate, and it is also preferable that the linking members are provided radially closer to the inside than the discharge ports and are provided continuously on the outer periphery of the aforementioned loop-shaped seal portion.

Such a construction improves the rigidity of the retainers so that they are not deformed by great discharge pressure when there is a overload due to liquid compression and the like.

Also, according to another aspect of the present invention, the retainers have inclined pieces with a gentle slope, and the linking members link the inclined pieces so as to improve the rigidity of the retainers, particularly the rigidity of the inclined pieces of the retainers, thereby improving the effect of preventing deformation of the retainers due to the pressure of the discharged refrigerant.

Also, according to a further aspect of the present invention, inclined pieces with a steep slope connect the tip portions of the inclined pieces with a gentle slope to a retainer base plate, and the width dimensions of the base portions of the inclined pieces with a gentle slope are greater than the width dimensions of the tip portions thereof, thereby improving the rigidity of the retainers with a simple structure.

BRIEF DESCRIPTION OF THE DRAWINGS

Other objects and advantages of the present invention will be more fully understood by the attached drawings and the following description.

DESCRIPTION OF THE PREFERRED EMBODIMENTS

Figure 1:
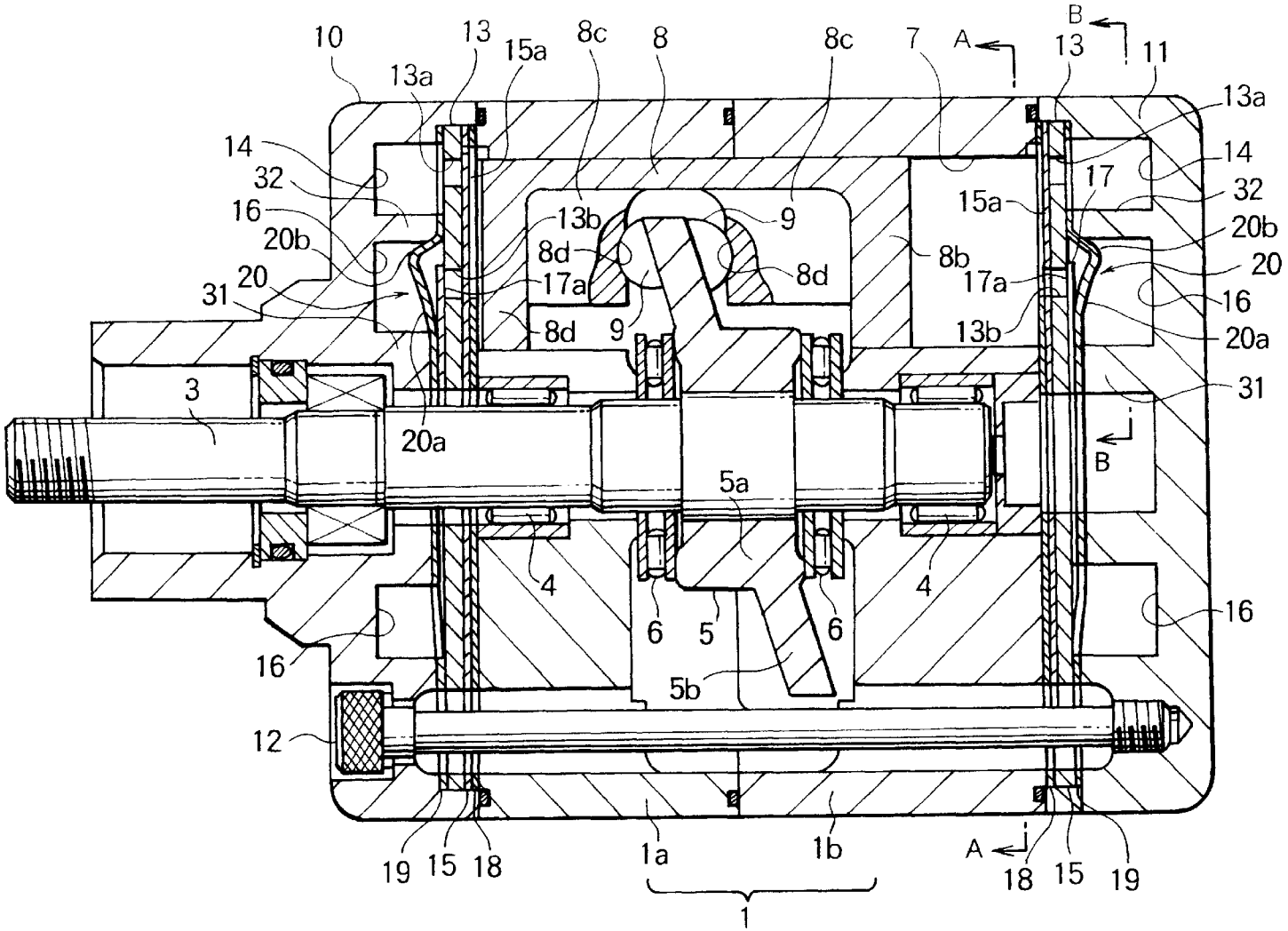
FIG. 1 is a longitudinal cross-sectional view of a reciprocating compressor according to a first embodiment of the present invention.

The following is a description of the preferred embodiments of the present invention, with reference to the FIGS. 1 through 9. In the drawings, parts which are identical or conceptually the same have the same reference numeral, and redundant description of such parts is omitted.

First, the first embodiment will be described with reference to FIGS. 1 through 5.

FIG. 1 is a longitudinal cross-sectional view of a reciprocating compressor according to the first embodiment with a cylinder assembly 1 being comprised of a rear cylinder block 1*b* joined to the rear end face of a front cylinder block 1*a*. The front cylinder block 1*a* and rear cylinder block 1*b* are formed of aluminum or an aluminum alloy or the like.

A drive shaft 3 is provided at the center of the cylinder assembly 1. The drive shaft 3 is rotatably supported by a pair of front and rear radial bearings 4 provided at the front cylinder block 1*a* and rear cylinder block 1*b*, and a swash plate formed of aluminum or an aluminum alloy or the like is mounted thereon as a cam plate 5.

The cam plate 5 has a hub 5*a* at the center thereof. Also, a round swash portion 5*b* inclined with respect to the axial direction of the drive shaft is integrally provided with the hub 5*a* at the perimeter thereof. Also, a pair of front and rear thrust bearings 6 are provided between both ends of the hub 5*a* and the cylinder blocks 1*a* and 1*b* in order to support the load applied to the cam plate 5 in the front and rear directions.

Figure 2:
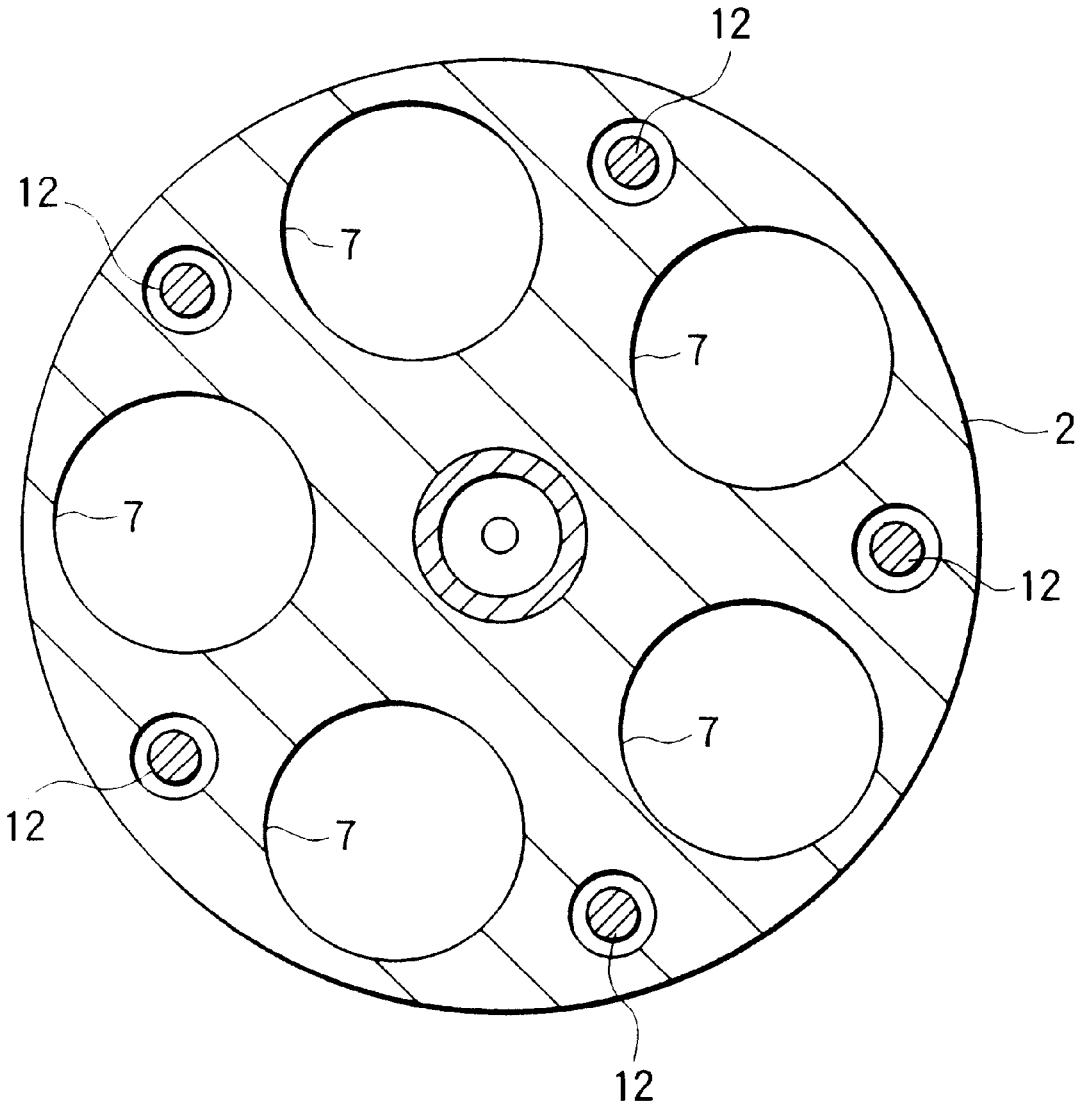
FIG. 2 is a cross-sectional view along line A—A in FIG. 1.

On the other hand, as shown in FIG. 2, a plurality of cylinder bores 7 are bored in the cylinder assembly 1, so as to pass therethrough between the front and rear end faces and are provided at equal intervals on a certain circumference with the drive shaft 3 as the center thereof. Double-headed pistons 8 (see FIG. 1) formed of aluminum alloy or the like are accommodated within the cylinder bores 7 so as to be reciprocatingly movable.

The pistons 8 have a front cylindrical portion 8*a* for compressing the refrigerant gas with the front side of the cylinder bore 7, and a rear cylindrical portion 8*b* for compressing the refrigerant gas in the rear side of the cylinder bore 7. Also, each of the pistons 8 have a pair of front and rear swash plate engaging members 8*c* between the front cylindrical portion 8*a* and rear cylindrical portion 8*b*. Spherical shoe seats 8*d* are formed so as to oppose each other in the swash plate engaging members 8*c*. Half-sphere-shaped shoes 9 slidably engage the spherical shoe seats 8*d*. Each of the pistons 8 engage both sides of the swash plate portion 5*b* of the cam plate 5 via these shoes 9 in a configuration such that, reciprocating movement of the pistons 8 in the cylinder bores 7 accompanies the rotation of the cam plate 5.

As shown in FIG. 1, a front cylinder cover 10 and a rear cylinder cover 11 are connected to the cylinder assembly 1 by a plurality of bolts 12 passing through the cylinder assembly 1, so as to close off the cylinder bores 7. The cylinder covers 10 and 11 are formed of aluminum alloy or the like. An inner circumference loop-shaped partition 31 and an outer circumference loop-shaped partition 32, with a discharge chamber provided there between, are also formed therein in a generally concentric manner, and further, an suction chamber 14 is formed at the outer side of the outer circumference loop-shaped partition 32.

Figure 3:
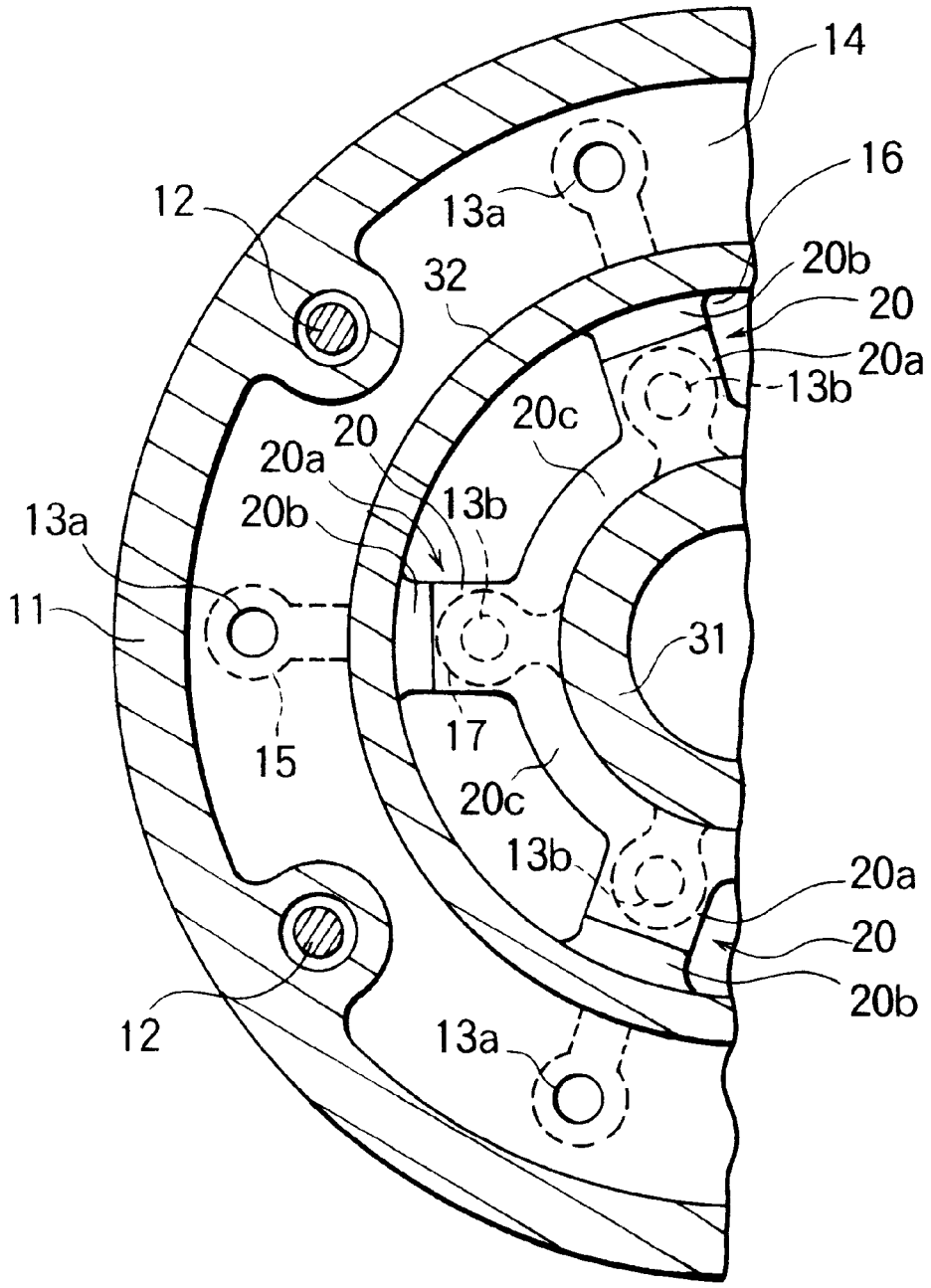
FIG. 3 is a cross-sectional view along line B—B in FIG. 1.

Valve plates 13, formed of a thick metal plate, are introduced between both ends of the cylinder assembly 1 and the cylinder covers 10 and 11. As shown in FIG. 3, a plurality of suction ports 13*a* linking the cylinder bores 7 and the suction chamber 14 are bored in the valve plates 13 to the radially outward side of the the valve plates 13, and a plurality of discharge ports 13*b* linking the cylinder bores 7 and the discharge chamber 16 are bored in the valve plates 13 at a radially inner side of the valve plates 13.

Also, as shown in FIG. 1, an suction valve forming plate 15 and gasket 18 are introduced between each valve plate 13 and both ends of the cylinder assembly 1. The suction valve forming plates 15 are formed by pressing a metal plate into a desired shape and have a plurality of suction valves 15*a* formed integrally therein for opening and closing the suction ports 13*a* formed in the valve plate 13.

In addition, a discharge valve forming plate 17 and retainer plate 19 are disposed between the valve plate 13 and front cylinder cover 10, and between the valve plate 13 and rear cylinder cover 11.

The discharge valve forming plates 17 are formed by pressing a metal plate into a desired shape, and have a plurality of discharge valves 17*a* formed integrally therein for opening and closing the discharge ports 13*b* formed in the valve plate 13.

Figure 4:
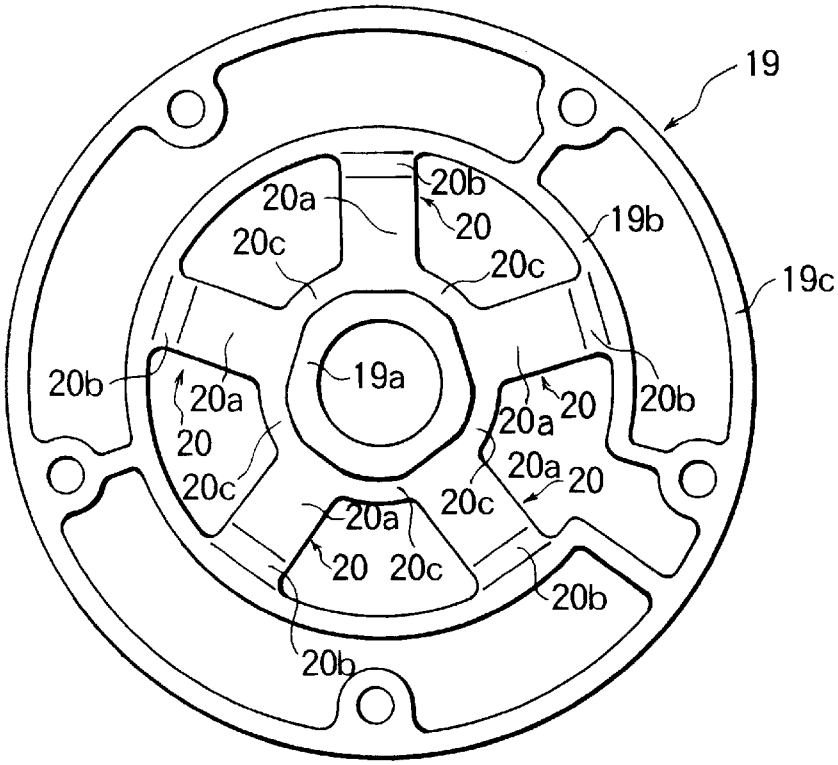
FIG. 4 is a plan view of the retainer plate shown in FIG. 1.

The retainer plate 19 is formed as a gasket by coating a metal plate with sealant and, as shown in FIG. 4, has the following: an inner circumference loop-shaped seal portion 19*a* held between the edge of the aforementioned inner circumference loop-shaped partition 31 and the edge of the cylinder assembly 1; an intermediate loop-shaped seal portion 19*b* held between the edge of the aforementioned outer circumference loop-shaped partition 32 and the edge of the cylinder assembly 1; and an outer loop-shaped seal portion 19*c* held between the edges of the cylinder covers 10 and 11 and the edges of the cylinder assembly 1. These loop-shaped seal portions 19*a*, 19*b*, and 19*c* form the base plate surface of the retainer plate. The inner circumference loop-shaped seal portion 19*a* is pressed against the cylinder assembly 1 by means of the inner circumference loop-shaped partition 31, thereby sealing the inner circumference of the discharge chamber 16. The intermediate loop-shaped seal portion 19*b* is pressed against the cylinder assembly 1 by means of the outer circumference loop-shaped partition 32, thereby sealing the border between the discharge chamber 16 and the suction chamber 14. Also, the outer loop-shaped seal portion 19*c* is pressed against the cylinder assembly 1 by means of the cylinder covers 10 and 11, thereby sealing the outer circumference of the suction chamber 14.

Also, the retainer plate 19 has a plurality of retainers 20 between the inner circumference loop-shaped seal portion 19*a* and the intermediate loop-shaped seal portion 19*b*, for restricting the degree of opening of reed-type discharge valves 17*a*. Accordingly, the retainers 20 are defined by being formed between the loop-shaped seal portions 19*a* and 19*b*, and their detailed construction will be described below.

The retainers 20 are formed so as to radially extend from the outer circumference of the inner circumference loop-shaped seal portion 19*a* toward the inner circumference of the intermediate loop-shaped seal portion 19*b* (FIGS. 3 and 4). Each retainer 20 has an inclined piece 20*a* with a gentle slope from the perimeter of the inner circumference loop-shaped seal portion 19*a* forming the base plate surface, and an inclined piece 20*b* with a sharp decline from the tip of the inclined piece 20*a* toward the intermediate loop-shaped seal portion 19*b* where it is connected. The inclined piece 20*a* with a gentle slope serves as member for restricting the opening angle of the reed valve type discharge valve 17*a*. The inclined piece 20*b* with a sharp decline is formed to improve the rigidity of the inclined piece 20*a*.

Figure 5:
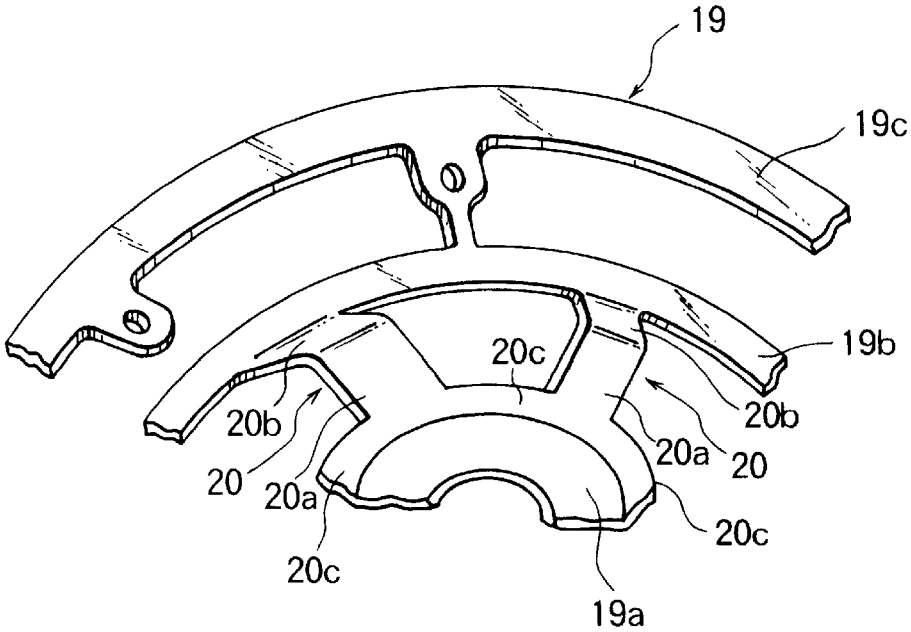
FIG. 5 is a partly perspective view of the retainer plate shown in FIG. 1.

Further, each the retainer thus formed has the aforementioned inclined pieces 20*a* thereof mutually linked by means of linking members 20*c* (see FIG. 5). Also, the perimeter of the aforementioned inner circumference loop-shaped seal portion 19*a* is defined by the perimeter of the portion which is pressed to the inner circumference loop-shaped partition 31 of the cylinder covers 10 and 11, and the linking members 20*c* are formed integrally with the retainer plate 19 and provided continuously from the perimeter of the inner circumference loop-shaped seal portion 19*a*. Also, this formation is further to the inside radially than the discharge ports 13*b*.

Accordingly, with a reciprocating compressor constructed as above, the base portions of the inclined pieces 20*a* are mutually linked by means of linking members 20*c* provided continuously at the perimeter of the inner circumference loop-shaped seal portion 19*a*, thereby further improving the rigidity of the inclined pieces 20*a* with a gentle slope serving as members for restricting the opening angle of the reed valve type discharge valve 17*a*. Accordingly, with the above-described first embodiment, deformation of the retainers 20 by the pressure of discharged refrigerant when there is a overload due to liquid compression and the like can be prevented, thus improving the reliability of the compressor.

Also, with the above-described first embodiment, the linking member 20*c* is formed further to the inside radially than the discharge ports 13*b*, so as to increase the rigidity of the retainers 20 without adversely affecting the flow of the refrigerant gas discharged from the discharge ports 13*b*, hence preventing deformation of the retainers 20.

Figure 6:
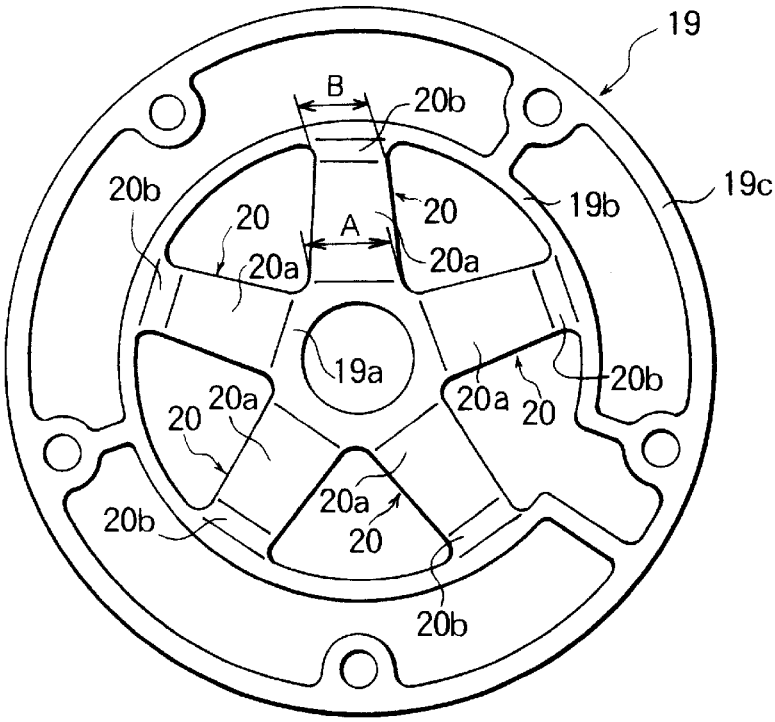
FIG. 6 is a plan view of the retainer plate of a second embodiment of the present invention.

Next, a second embodiment will be described with reference to FIG. 6. The second embodiment is an arrangement wherein the linking members 20*c* provided in the first embodiment are not provided, and the rigidity of the retainers 20 are improved. As shown in FIG. 6, the width dimensions A of the base portion of the inclined pieces 20*a* with a gentle slope are made to be greater than the width dimensions B of the tip portions thereof, thereby improving the rigidity of the base portions of the retainers 20 and consequently improving the rigidity of the retainers 20 themselves.

Figure 7:
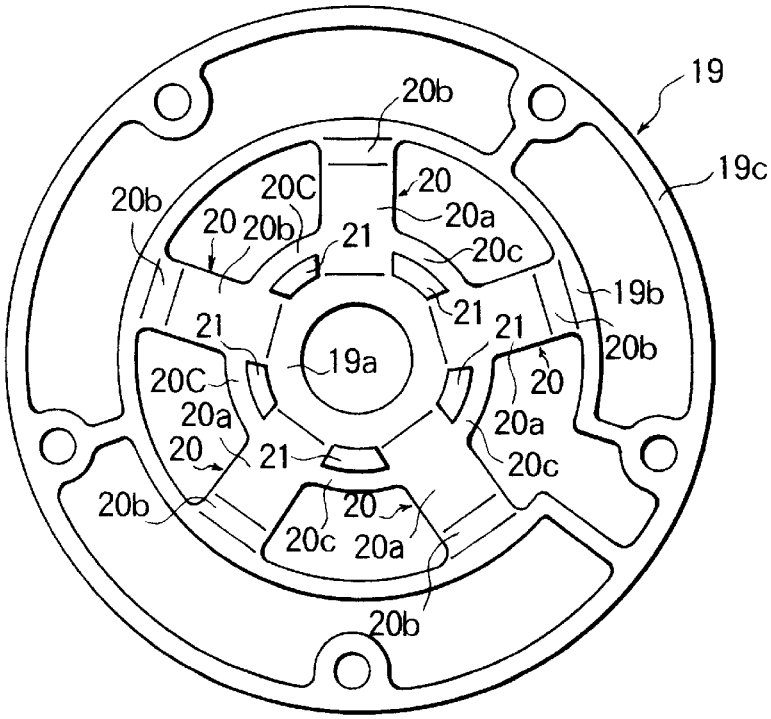
FIG. 7 is a plan view of the retainer plate of a third embodiment of the present invention.

Next, a third embodiment will be described with reference to FIG. 7. As shown in FIG. 7, the third embodiment involves positioning the linking members 20*c* at middle portions of the inclined pieces 20*a*, thus improving the rigidity of the retainers 20, with the linking members 20*c*, in a more efficient manner. Further, with such an arrangement, since the linking members 20*c* approach the area directly over the discharge ports 13*b*, if the linking members 20*c* are provided continuously from the inner circumference annular seal portion 19*a*, as in the first embodiment, the flow resistance of the refrigerant gas discharged from the discharge ports 13*b* increases. However, with the present embodiment, since an opening 21 is provided between the inner circumference loop-shaped seal portion 19*a* and the linking member 20*c* an increase in the flow resistance of the refrigerant is prevented.

Next, a fourth embodiment will be described with reference to FIGS. 8 and 9.

The aforementioned first embodiment is an example of application to a double-headed swash plate compressor with the cylinder covers 10 and 11 arranged such that the discharge chamber 16 is radially inward and the suction chamber 14 is radially outward, but the fourth embodiment is an example of application to a double-headed swash plate compressor with the cylinder covers arranged such that the discharge chamber is radially outward and the suction chamber is radially inward.

Figure 8:
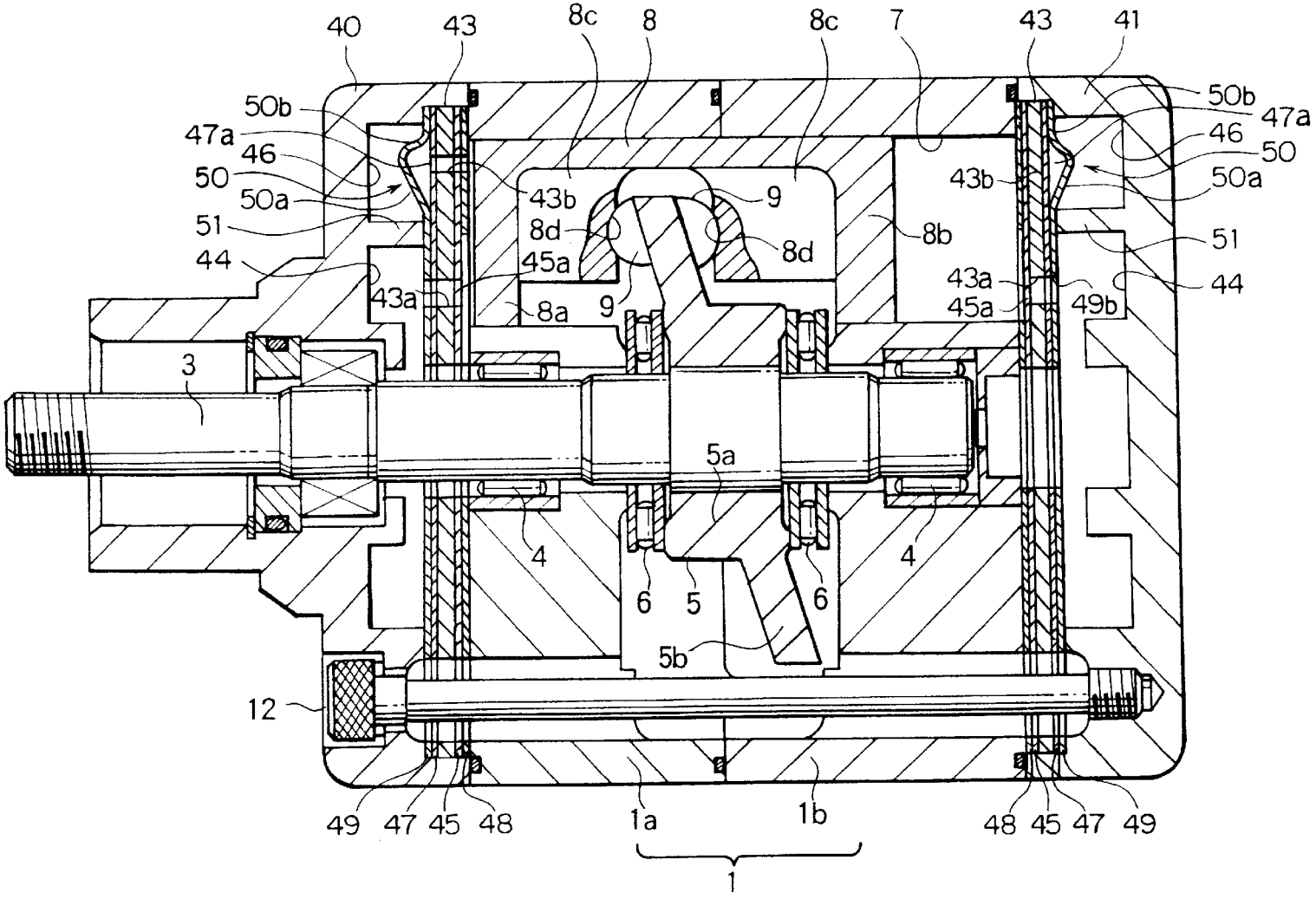
FIG. 8 is a longitudinal cross-sectional view of a reciprocating compressor according to a fourth embodiment of the present invention.
Figure 9:
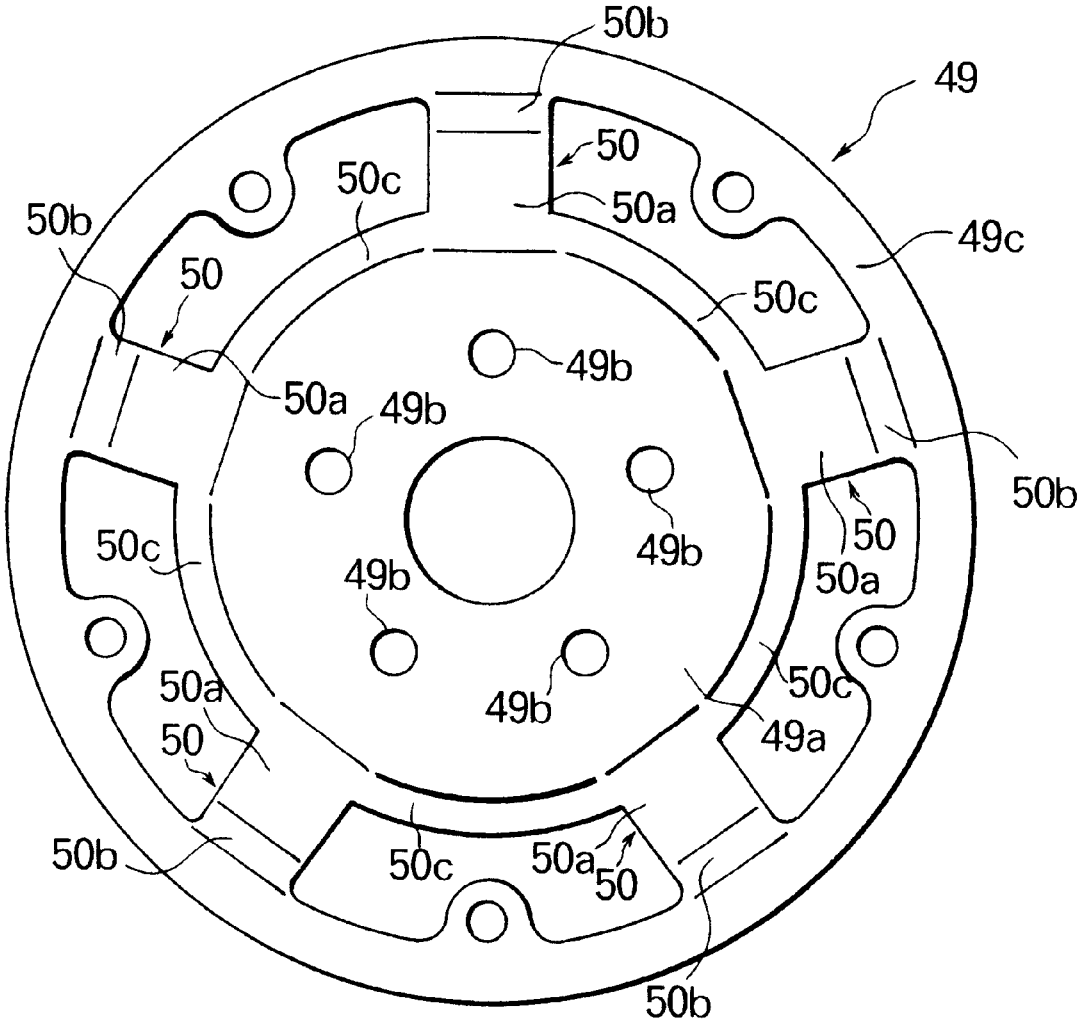
FIG. 9 is a plan view of the retainer plate according to the fourth embodiment of the present invention.

FIG. 8 is a longitudinal cross-sectional view of a reciprocating compressor the similar to that of FIG. 1, wherein 40 denotes a front cylinder cover and 41 denotes a rear cylinder cover. The cylinder covers 40 and 41 have a loop-shaped partition 51, with the suction chamber 44 being formed at the inner circumference of the loop-shaped partition 51, and the discharge chamber 46 being formed at the outer circumference of the loop-shaped partition 51. Valve plates 43 each having a plurality of suction ports 43*a* and a plurality of discharge ports 43*b* are introduced between the cylinder covers 40 and 41 and the cylinder assembly 1. An suction valve forming plate 45 integrally comprising a plurality of suction valves, and a gasket 48 are introduced between the valve plates 43 and both ends of the cylinder assembly 1. Also, a discharge valve forming plate 47 and a retainer plate 49 are introduced between the valve plates 43 and the cylinder covers 40 and 41. The discharge valve forming plate 47 is formed by integrally forming reed-type valves in a radial fashion. Also, the retainer plate 49 is integrally formed with a plurality of retainers 50 for restricting the degree of opening of the discharge valve 47*a* and the gaskets 48 for sealing the chambers 44 and 46.

This retainer plate 49 has an inner circumference loop-shaped seal portion 49*a* held between the edges of the loop-shaped partition 51 and the edges of the cylinder assembly 1, thereby sealing the discharge chamber 46 and the suction chamber 44, with a plurality of suction holes 49*b* bored in the inner circumference loop-shaped seal portion 49*a*. Also, the retainer plate 49 has an outer loop-shaped seal portion 49*c* which is held between the peripheral wall edges of the cylinder covers 40 and 41 and the edges of the cylinder assembly 1, thereby sealing the perimeter of the discharge chamber 46. The above inner circumference loop-shaped seal portion 49*a* and outer loop-shaped seal portion 49*c* form the base plate surface of the retainer plate 49. Then, a plurality of retainers 50 which restrict the degree of opening of the discharge valves 47*a* are radially provided between the outer loop-shaped seal portion 49*c* and inner circumference loop-shaped seal portion 49*a*.

The retainers 50 have an inclined piece 50*a* with a gentle slope from the perimeter of the inner circumference loop-shaped seal portion 49*a* forming the base plate surface, and an inclined piece 50*b* with a sharp decline from the tip thereof is connected to the outer loop-shaped seal portion 49*c*. The inclined pieces 50*a* are mutually linked at the bases thereof by means of linking members 50*c*. Also, the perimeter of the aforementioned inner circumference loop-shaped seal portion 49*a* is defined by the perimeter of the portion which is pressed to the inner circumference loop-shaped partition 31 of the cylinder covers 10 and 11, and the linking members 50*c* are provided continuously from the perimeter of the inner circumference loop-shaped seal portion 49*a*.

Accordingly, with a reciprocating compressor constructed as described in the fourth embodiment, the base portions of the inclined pieces 50*a* are mutually linked by means of the linking members 50*c* provided continuously with the perimeter of the inner circumference loop-shaped seal portion 49*a*, thereby further improving the rigidity of the inclined pieces 50*a*. Accordingly, the retainers 50 are not deformed by the pressure of discharged refrigerant when there is a overload due to liquid compression and the like, and the opening of the discharge valves 47*a* can be maintained at an appropriate degree, thereby improving the reliability of the compressor.

Although the above-described embodiments are applications of the present invention to double-headed swash plate compressors, the present invention can be applied to other types of compressors, as well. For example, instead of the aforementioned double-headed swash plate compressor, the present invention can be applied to a reciprocating compressor such as a single-head swash plate compressor wherein the cylinder bores are provided in the cylinder assembly and are covered with a cylinder cover which has an suction chamber and a discharge chamber, so as to reciprocatingly slide the single-head piston within the cylinder bore.

Thus, it is clearly understood that various embodiments can be constructed without exceeding the spirit and scope of the present invention, and accordingly the present invention is by no means limited to any particular embodiment, except as restricted in the attached claims.

What is claimed is:

1. A reciprocating compressor, comprising:

a cylinder assembly wherein a plurality of cylinder bores are arrayed upon a certain circumference;

a drive shaft rotatably supported at the center of said cylinder assembly;

a cam plate mounted to said drive shaft;

a plurality of pistons which reciprocatingly move within said cylinder bores, the rotational force of said drive shaft transmitted as reciprocating motion thereto via said cam plate;

at least one cylinder cover provided so as to cover the end of said cylinder assembly, with a generally loop-shaped discharge chamber and a generally loop-shaped suction chamber formed therein in a generally concentric manner;

a valve plate provided between said cylinder cover and said cylinder assembly;

a plurality of discharge ports bored at certain positions on a certain circumference in said valve plate;

a discharge valve formation plate which is introduced between said cylinder cover and said valve plate, integrally forming a plurality of reed discharge valves which open and close said discharge ports;

a retainer plate which is introduced between said cylinder cover and said discharge valve formation plate, having a loop-shaped sealing portion which seals the edge of the inner circumferential wall of said discharge chamber formed in said cylinder cover, said retainer plate being integrally formed of a plurality of retainers for restricting the degree of opening of said discharge valves, said retainers radially protruding from the periphery of said loop-shaped sealing portion; and linking members linking neighboring said retainers one to another.

2. A reciprocating compressor according to claim 1, wherein said retainers have an inclined piece, and wherein said linking members link said inclined pieces.

3. A reciprocating compressor according to claim 1, wherein the suction chamber of said cylinder cover is formed radially outward of said discharge chamber.

4. A reciprocating compressor according to claim 1, wherein the suction chamber of said cylinder cover is formed radially inward of said discharge chamber.

5. A reciprocating compressor according to claim 1, wherein said linking members are formed integrally with said retainer plates.

6. A reciprocating compressor according to claim 1, wherein said linking members are formed at a position further to the inside of said circumference than the discharge ports.

7. A reciprocating compressor according to claim 1, wherein said linking members are formed continuously with the periphery of said loop-shaped sealing portion.

8. A reciprocating compressor, comprising:

a cylinder assembly wherein a plurality of cylinder bores are arrayed upon a certain circumference;

a drive shaft rotatably supported at the center of said cylinder assembly;

a cam plate mounted to said drive shaft;

a plurality of pistons which reciprocatingly move within said cylinder bores, the rotational force of said drive shaft transmitted as reciprocating motion thereto via said cam plate;

at least one cylinder cover provided so as to cover the end of said cylinder assembly, with a generally loop-shaped discharge chamber and a generally loop-shaped suction chamber formed therein in a generally concentric manner;

a valve plate provided between said cylinder cover and said cylinder assembly;

a plurality of discharge ports bored at certain positions on a certain circumference in said valve plate;

a discharge valve formation plate which is introduced between said cylinder cover and said valve plate, integrally forming a plurality of reed discharge valves which open and close said discharge ports;

a retainer plate which is introduced between said cylinder cover and said discharge valve formation plate, having a loop-shaped sealing portion which seals the edge of the inner circumference wall of said discharge chamber formed in said cylinder cover, said retainer plate being integrally formed of a plurality of retainers for restricting the degree of opening of said discharge valves, said retainers radially protruding from the periphery of said loop-shaped sealing portion in radial directions, and having an inclined piece; and linking members linking the inclined pieces of neighboring said retainers one to another.

9. A reciprocating compressor according to claim 8, wherein the suction chamber of said cylinder cover is formed radially outward of said discharge chamber.

10. A reciprocating compressor according to claim 8, wherein the suction chamber of said cylinder cover is formed radially inward of said discharge chamber.

11. A reciprocating compressor according to claim 8, wherein said linking members are formed integrally with said retainer plates.

12. A reciprocating compressor according to claim 8, wherein said linking members are formed at a position further to the inside from the circumference than said discharge ports.

13. A reciprocating compressor according to claim 8, wherein said linking members are formed continuously with the periphery of said loop-shaped sealing portion.

14. A reciprocating compressor, comprising:

a cylinder assembly wherein a plurality of cylinder bores are arrayed upon a certain circumference;

a drive shaft rotatably supported at the center of said cylinder assembly;

a cam plate mounted to said drive shaft;

a plurality of pistons which reciprocatingly move within said cylinder bores, the rotational force of said drive shaft transmitted as reciprocating motion thereto via said cam plate;

at least one cylinder cover provided so as to cover the end of said cylinder assembly, with a generally loop-shaped discharge chamber and a generally loop-shaped suction chamber formed therein in a generally concentric manner;

a valve plate provided between said cylinder cover and said cylinder assembly;

a plurality of discharge ports bored at certain positions on a certain circumference in said valve plate;

a discharge valve formation plate which is introduced between said cylinder cover and said valve plate, integrally forming a plurality of reed discharge valves which open and close said discharge ports; and a retainer plate which is introduced between said cylinder cover and said discharge valve formation plate, having a loop-shaped sealing portion which seals the edge of the inner circumference wall of said discharge chamber formed in said cylinder cover, said retainer plate being integrally formed of a plurality of retainers for restricting the degree of opening of said discharge valves, said retainers radially protruding from the periphery of said loop-shaped sealing portion, and having an inclined piece with a first slope;

wherein said retainer is arranged such that the tip portions of said inclined pieces with a first slope are connected to a retainer base plate by inclined pieces with a second slope, and such that the width dimension of the base portion of said inclined pieces with a first slope is greater than the width dimension of the tip portion thereof.

* * * * *